US008281874B2

(12) United States Patent
Imada et al.

(10) Patent No.: US 8,281,874 B2
(45) Date of Patent: Oct. 9, 2012

(54) POWER TOOL WITH VIBRATION DAMPING HANDLE

(75) Inventors: Kenjirou Imada, Fuchu (JP); Yuji Imai, Fuchu (JP)

(73) Assignee: Ryobi Ltd., Hiroshima (JP)

( * ) Notice: Subject to any disclaimer, the term of this patent is extended or adjusted under 35 U.S.C. 154(b) by 348 days.

(21) Appl. No.: 12/666,523

(22) PCT Filed: Mar. 21, 2008

(86) PCT No.: PCT/JP2008/055287

§ 371 (c)(1),
(2), (4) Date: Dec. 23, 2009

(87) PCT Pub. No.: WO2009/001592

PCT Pub. Date: Dec. 31, 2008

(65) Prior Publication Data

US 2010/0181085 A1 Jul. 22, 2010

(30) Foreign Application Priority Data

Jun. 25, 2007 (JP) ..... 2007-166855
Nov. 12, 2007 (JP) ..... 2007-293160

(51) Int. Cl.
*B25F 5/02* (2006.01)

(52) U.S. Cl. ..... 173/162.2

(58) Field of Classification Search ..... None
See application file for complete search history.

(56) References Cited

U.S. PATENT DOCUMENTS 4,266,376 A * 5/1981 Overy ..... 451/294
4,648,468 A * 3/1987 Honsa ..... 173/210
4,771,833 A * 9/1988 Honsa ..... 173/162.2
5,027,910 A * 7/1991 Honsa et al. ..... 173/162.2
5,054,562 A * 10/1991 Honsa et al. ..... 173/210
5,267,487 A * 12/1993 Falco et al. ..... 74/558
7,766,097 B2 * 8/2010 Kondo ..... 173/217
2005/0155778 A1 * 7/2005 Ishida et al. ..... 173/217
2008/0257577 A1 * 10/2008 Tanaka et al. ..... 173/4

FOREIGN PATENT DOCUMENTS

| | | |
|---|---|---|
| JP | 61-103786 | 5/1986 |
| JP | 64-056979 | 4/1989 |
| JP | 3-054123 | 5/1991 |
| JP | 7-017478 | 3/1995 |
| JP | 7-205055 | 8/1995 |
| JP | 10-044062 | 2/1998 |
| JP | 11-300592 | 11/1999 |

OTHER PUBLICATIONS

International Search Report, PCT/JP2008/055287, Apr. 22, 2008.

* cited by examiner

*Primary Examiner* — Brian D Nash

(74) *Attorney, Agent, or Firm* — Young & Thompson

(57) ABSTRACT

Gel-like material or viscoelastic polymer is placed in a portion having a three-dimensional shape. A power tool driving force transmission mechanism transmits a rotary driving force from a rotary drive source to operate the power tool; and a housing provides an outer shell for the power tool. A tail cover is provided at at least a region of the housing, held by an operator; and gel-like material, enclosed by a resin film into a gel pack, is placed between the tale cover and the housing. The tail cover is composed of an elastomer member and a resin member, which is integrally formed with the elastomer member and has a higher hardness than the elastomer member. A portion receiving the gel pack is composed of the elastomer member, and a portion connected to the housing is composed of the resin member. The gel pack may be substituted with viscoelastic polymer.

14 Claims, 11 Drawing Sheets

(a)

(b)

(c)

POWER TOOL WITH VIBRATION DAMPING HANDLE

TECHNICAL FIELD

The present invention relates to a power tool, and especially to improvement of a power tool in which an impulse force transmitted to an operator may be reduced by placing gel-like material or viscoelastic polymer at a place, which is to be held by the operator.

BACKGROUND OF THE INVENTION

In the conventional power tool, an elastomer of a soft resin material is integrally formed with a grip to impart an additional anti-slip function to the grip. However, such an elastomer used in the conventional power tool has a smaller thickness and a higher hardness and therefore has a defect that it may not sufficiently prevent vibration and/or heat from being transferred to a hand.

An elastomer having a larger thickness may be formed by ingenious attempts in the manufacturing technique. However, the elastomer with such a larger thickness has a high repulsion and the use of the elastomer having such a larger thickness leads to increase in size of the grip portion of the power tool. Even if the thickness of the elastomer increased, factors (heat, vibration, etc.) causing an operator's fatigue during a working operation might not be reduced efficiently.

In vie of these problems, there have been developed such kinds of power tools in which a gel-like material was applied to the grip portion to improve vibration insulation and impact absorption as disclosed in the following patent documents 1 and 2.

Patent Document 1: Japanese Patent Provisional Publication No. S61-103786

Patent Document 2: Japanese Patent Provisional Publication No. H7-205055

DISCLOSURE OF THE INVENTION

Subject to be Solved by the Invention

However, in the conventional prior art, there was no technique to provide a gel-like material on a portion having a complicated shape. As a result, there was a restriction that the gel-like material could be provided only in case where the gel-like material with substantially the same thickness extended along the axial direction in the longitudinal section of the gel-like material. The gel-like material could not be applied to the power tool in which consideration has been given to a shape of the grip to be held by an operator, unless such a restriction was removed.

In the technique disclosed in the above-mentioned Patent Document 2, a gel-like material is applied to a grip portion having a gun-shape by placing into the grip portion the gel-like material with which cells formed by a resin film are filled. However, the above-mentioned grip has a cross-section having substantially the C-shape with substantially the constant thickness. In addition, a grip cover, which encompasses the outer periphery of the gel-like material to form the grip, is a member, which requires a relatively high hardness for installation. Therefore, the power tool disclosed in the above-mentioned Patent Document 2, which has the hard grip cover as described above, includes a problem that the gel-like material cannot fully exert its resiliency, vibration insulation property and impact absorption property.

An object of the present invention, which was made in view of the above-described problems, is to provide a technique, which enables the gel-like material to be placed even at a region defined by a complicated shape in which consideration has been given to a shape of the grip to be held by an operator, and also enables the gel-like material to be applied to the power tool in a manner that the gel-like material can fully exert its characteristic properties (resiliency, vibration insulation and impact absorption). In addition, another object of the present invention is to provide a novel power tool to which viscoelastic polymer that can provide the same functions as the gel-like material is applied.

Means to Solve the Subject

The present invention will be described below. The following description includes reference numerals, which are shown in the accompanying drawings, with parentheses, in order to facilitate understanding of the present invention, while incorporation of such reference numerals does not mean that the present invention is limited only to embodiments as shown in the drawings.

A power tool according to the present invention comprises: a driving force transmission mechanism (20) that transmits a rotary driving force from a rotary drive source (11) to operate the power tool; and a housing (10) that receives the driving force transmission mechanism (20) therein and provides an outer shell for the power tool; wherein: a tail cover (40) is provided at at least a region of the housing (10), which is to be held by an operator; and a gel pack (50) in which gel-like material is enclosed by a resin film, or viscoelastic polymer is placed between the tale cover (40) and the housing (10).

In the power tool according to the present invention, there may be applied a structure in which the tail cover (40) comprises an elastomer member (41) and a resin member (41), which is integrally formed with the elastomer member and has a higher hardness than the elastomer member (41); and a portion, which receives the gel pack (50) or the viscoelastic polymer, is composed of the elastomer member (41), and a portion, which is connected to the housing (10), is composed of the resin member (42).

In the power tool according to the present invention, there may be applied a structure in which the tail cover (40) has a bilayer formation structure in which the elastomer member (41) is placed on an outer side of the resin member (42), and the gel pack (50) or the viscoelastic polymer is placed in a gel pack-receiving portion (44) or a viscoelastic polymer-receiving portion, which is composed only of the elastomer member (41) and is free of the resin member (42).

In the power tool according to the present invention, there may be applied a structure in which an adjacent portion of the resin member (42) to the gel pack-receiving portion (44) or the viscoelastic polymer-receiving portion has a shape to provide an undercut portion, when conducting a bilayer formation with the elastomer member (41); and the resin member (42) has a shape to be fitted into a mold (60), when forming the resin member (42) and the elastomer member (41) integrally with each other to form the tale cover (40).

In the power tool according to the present invention, there may be applied a structure in which the resin member (42) is provided at an adjacent portion thereof to the gel pack-receiving portion (44) or the viscoelastic polymer-receiving portion with a slit (45) to enable the resin member (42) to be easily fitted into the mold (60), when inserting the resin member (42) into the mold (60).

In the power tool according to the present invention, there may preferably be applied a structure in which each of the housing (10) and the tale cover (40) has a three-dimensional shape having a plurality of curved surfaces; and the gel pack (50) or the viscoelastic polymer, which is placed in a space defined by the three-dimensional shape, has notches (51) matching with the three-dimensional shape.

In the power tool according to the present invention, there may be applied a structure in which the power tool further comprises an operation switch (30) provided on a front side of the power tool to control operation thereof; and wherein: the gel pack (50) or the viscoelastic polymer is placed to cover at least regions of a rear side and both of opposite sides of the housing (10) in which the operation switch (30) is provided.

In the power tool according to the present invention, there may be applied a structure in which the gel pack (50) or the viscoelastic polymer has through-holes (52) to prevent movement thereof between the tale cover (40) and the housing (10) to secure the gel pack (50) or the viscoelastic polymer to the housing (10).

Effects of the Invention

According to the power tool of the present invention, it is possible to place the gel-like material or the viscoelastic polymer even at a region defined by a complicated shape in which consideration has been given to a shape of the grip to be held by an operator. In addition, according to the power tool of the present invention, it is possible to cause the gel-like material or the viscoelastic polymer to fully exert its characteristic properties (resiliency, vibration insulation and impact absorption).

EXPLANATION OF THE REFERENCE NUMERALS

10: housing; 10*a*: housing body; 10*b*: housing grip; 10*c*: recess; 11: motor; 12: output shaft of the motor; 20: driving force transmission mechanism; 23: planetary gear train; 23*a*: planetary gear; 23*b*: supporting shaft; 23*c*: internal gear; 24: spindle; 25: impact mechanism; 25*a*: anvil; 25*b*: hammer; 25*c*: drill holder; 26: first bearing; 27: pinion gear; 28: second bearing; 30: operation switch; 40: tale cover; 41: elastomer member; 42: resin member; 42*a*: projection; 43: bolt-hole; 44: gel-pack receiving portion; 45: slit; 50: gel-pack; 51: notch; 52: through-hole; 60: secondary formation mold; 61: mold

BEST MODE FOR CARRYING OUT THE INVENTION

Now, preferred embodiments for carrying out the present invention will be described in detail below with reference to the drawings. All of the combinations of features described in the embodiment of the present invention are not necessarily essential to the means to solve the subject of the invention. The power tool according to the embodiments of the present invention will be described as an example of a battery-powered impact driver, although the power tool according to the present invention is not limited only to such a type of power tool, but the present invention may be applied to every kinds of power tools such as a power tool with a cord connection-electric power supply system or a power tool used in the form of a drill, a screw driver, a wrench, a saw, a hammer drill, a grinder, a mixer, a trimmer or the like.

Figure 1:
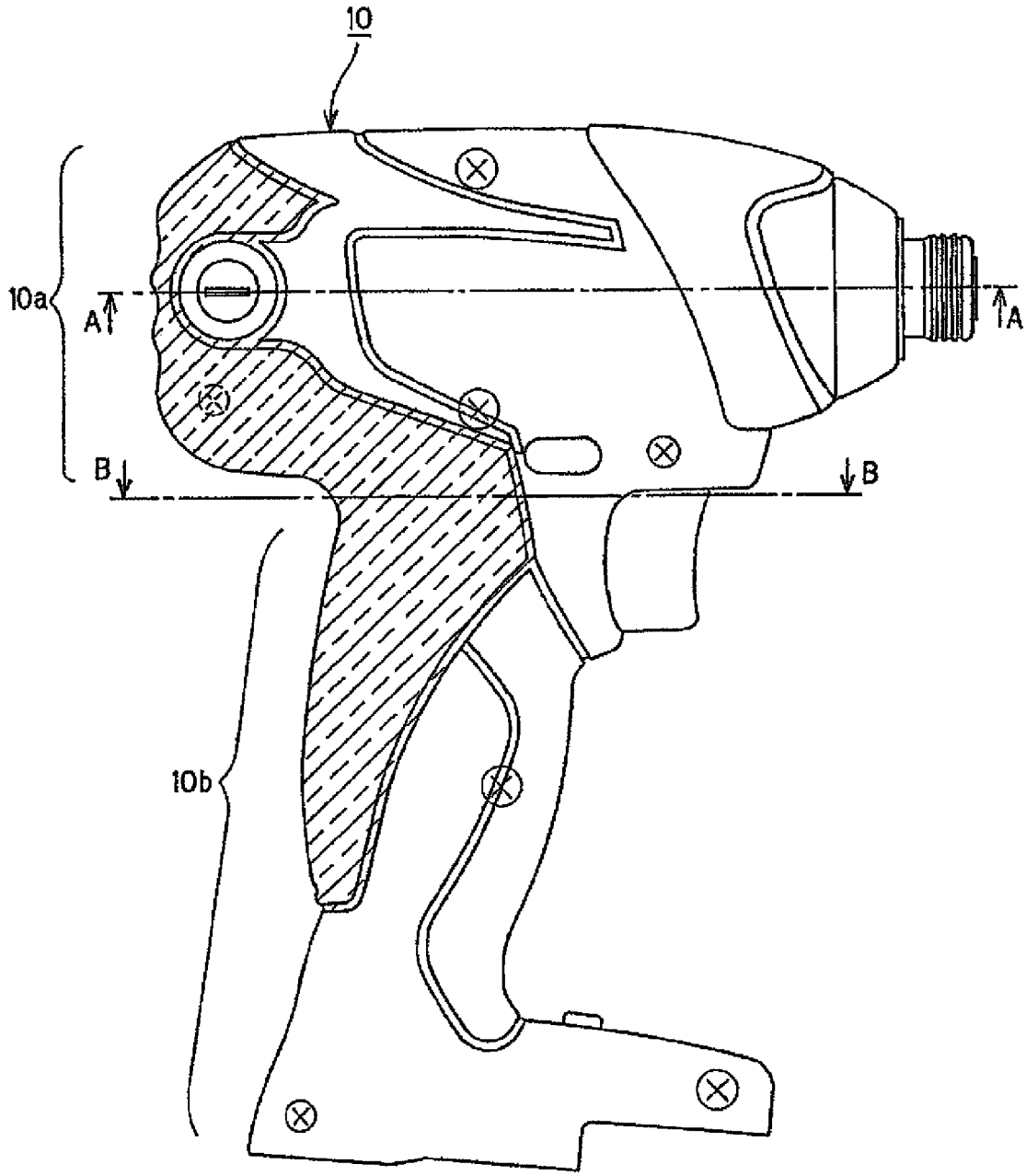
FIG. 1 is an external appearance side view showing a whole structure of a power tool according to the embodiment of the present invention, in a state where a battery pack is removed from a housing.
Figure 2:
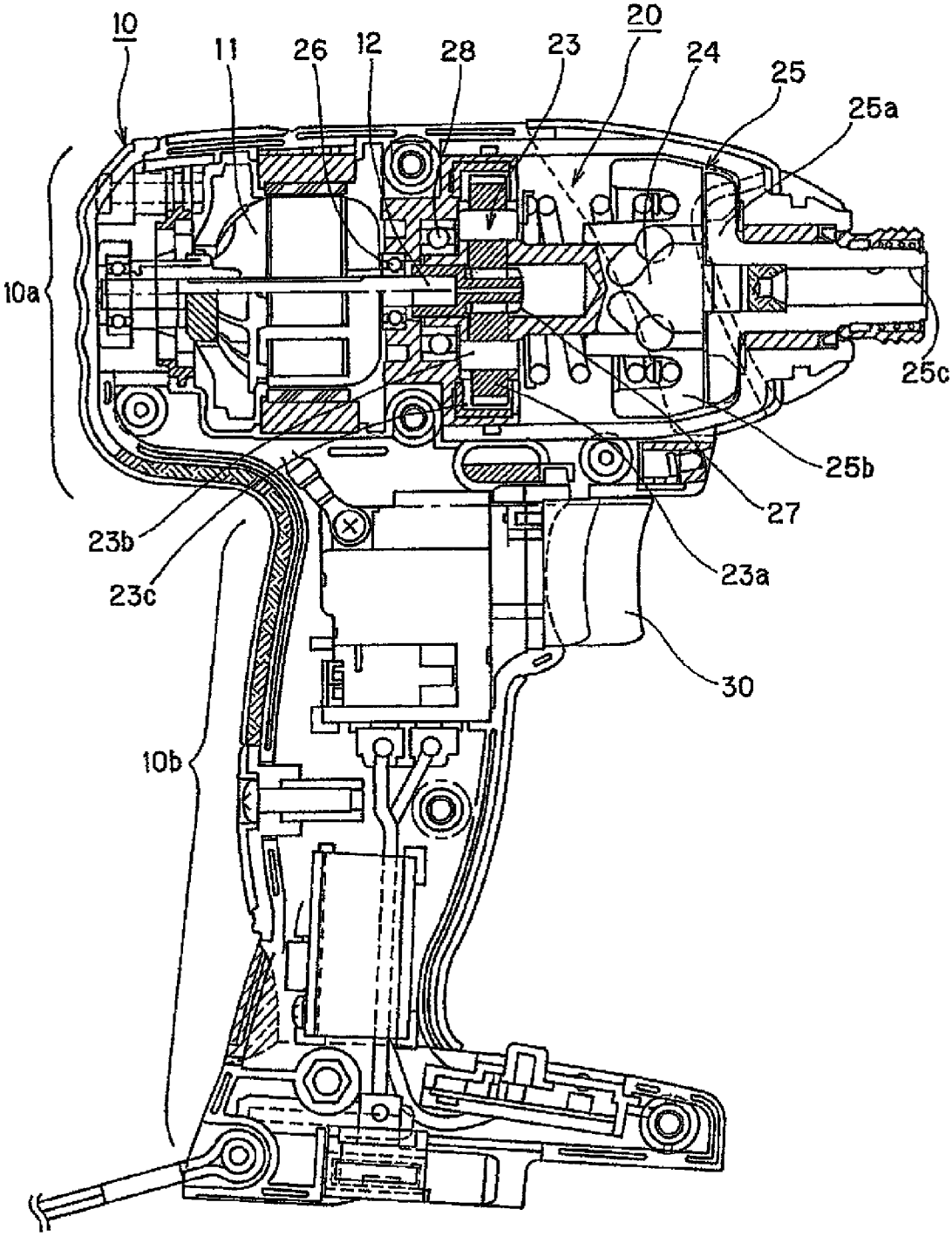
FIG. 2 is a longitudinal sectional view of the power tool as shown in FIG. 1.
Figure 3:
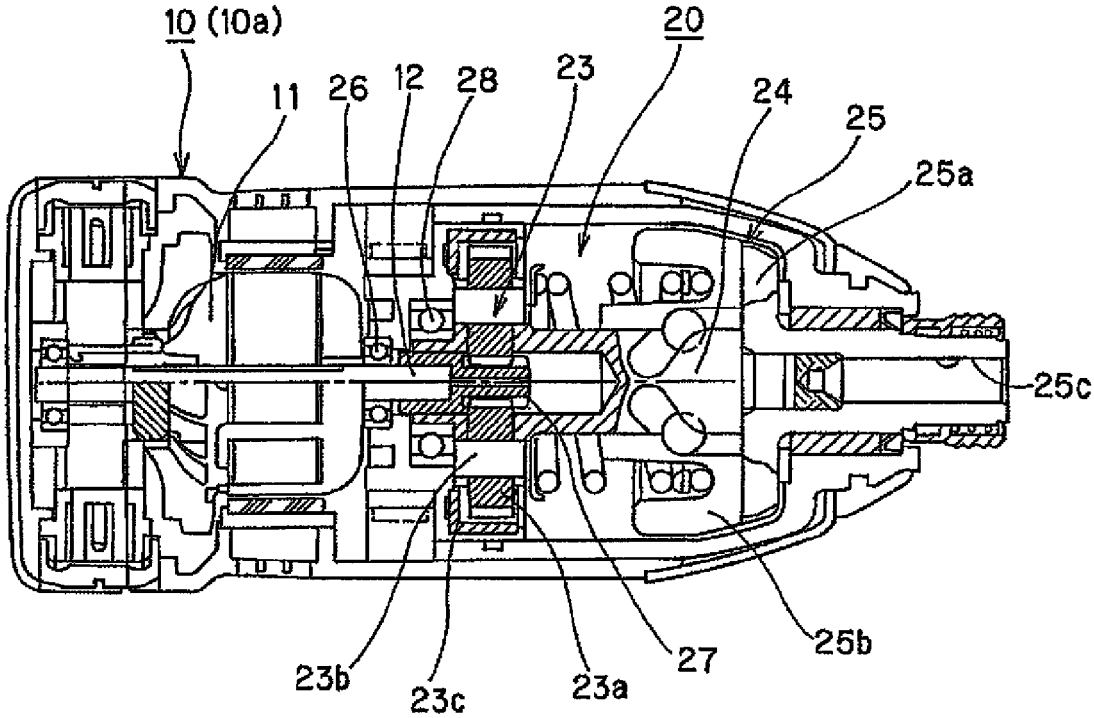
FIG. 3 is a sectional view cut along the line A-A as shown in FIG. 1.

FIG. 1 is an external appearance side view showing a whole structure of a power tool according to the embodiment of the present invention, in a state where a battery pack is removed from a housing. FIG. 2 is a longitudinal sectional view of the power tool as shown in FIG. 1 and FIG. 3 is a sectional view cut along the line A-A as shown in FIG. 1.

The power tool according to the embodiment of the present invention is manufactured as an impact driver and has primary structural components of a motor 11 serving as a rotary drive source; a driving force transmission mechanism 20 that transmits a rotary driving force from the motor 11 to operate the power tool; a housing 10 that receives the driving force transmission mechanism 20 therein and provides an outer shell for the power tool; and a not-shown battery pack, which is detachably provided on the housing 10 to supply a driving electric power to the motor 11.

The housing 10 is composed of a housing body 10*a*, which is capable of receiving an attachment tool on the front side, and a housing grip 10*b*, which extends downward from the housing body 10*a* to be held by an operator. The housing grip 10*b* is provided on the front and upper side with an operation switch 30 to turn the motor 11 serving as the rotary drive source on or off. The housing grip 10*b* has, at regions of a rear side and both of opposite sides of the housing grip 10*b* in which the operation switch 30 is provided, a three-dimensional shape having a plurality of curved surfaces, which appropriately fits the operator's hand.

The housing body 10*a* is provided on the front side thereof with a drill holder 25*c* serving as a chuck device for holding the not shown-attachment tool to drive it. A position at which the drill holder serving as the chuck device is provided is determined so that the not shown-attachment tool through which the driving force is applied to an object to be worked by operating the power tool by the operator may face the object to be worked. The housing body 10*a* receives therein the motor 11 that may supply the driving force to the attachment tool (not shown) attached to the drill holder 25*c* serving as the chuck device.

The driving force transmission mechanism 20 according to the embodiment of the present invention comprises a planetary gear train 23 for deceleration, which is connected to a motor output shaft of the motor 11, a spindle 24 rotary-driven by a driving force of the motor 11 transmitted through the planetary gear train 23, and an impact mechanism 25 connected to the spindle 24.

The motor output shaft 12 of the motor 11, which is fixedly provided in the housing body 10*a*, is rotatably supported at the end of the shaft thereof on the attachment tool side through the first bearing 26 and the motor output shaft 12 has a pinion gear 27 fitted thereto. A plurality of planetary gears 23*a* of the planetary gear train 23 engage with the pinion gear 27, and each of the planetary gears 23*a* is rotatably supported on the spindle 24 through a corresponding shaft 23*b*. Each of the planetary gears 23*a* engages with an internal gear 23*c*, which is stationary provided in the inside of the housing 10. The spindle 24 is rotatably supported within the housing body 10*a* through the second bearing 28, and the operation of the motor 11 causes the rotational power of the motor to be transmitted through the planetary gear train 23 to the spindle to rotate it at a predetermined number of rotations.

The impact mechanism 25 is connected to the spindle 24. This impact mechanism 25 is provided with an anvil 25*a* to which the drill holder 25*c* serving as the not-shown chuck device is connected, and with a hammer 25*b*. Application of an external torque (screwing resistance) having a predetermined value or more to the anvil 25*a* through the attachment tool (not shown) and the drill holder 25*c* during the screwing operation causes the hammer 25*b* to strike the anvil 25*a* in the rotational direction, thus being able to perform a stronger screwing action.

Figure 4:
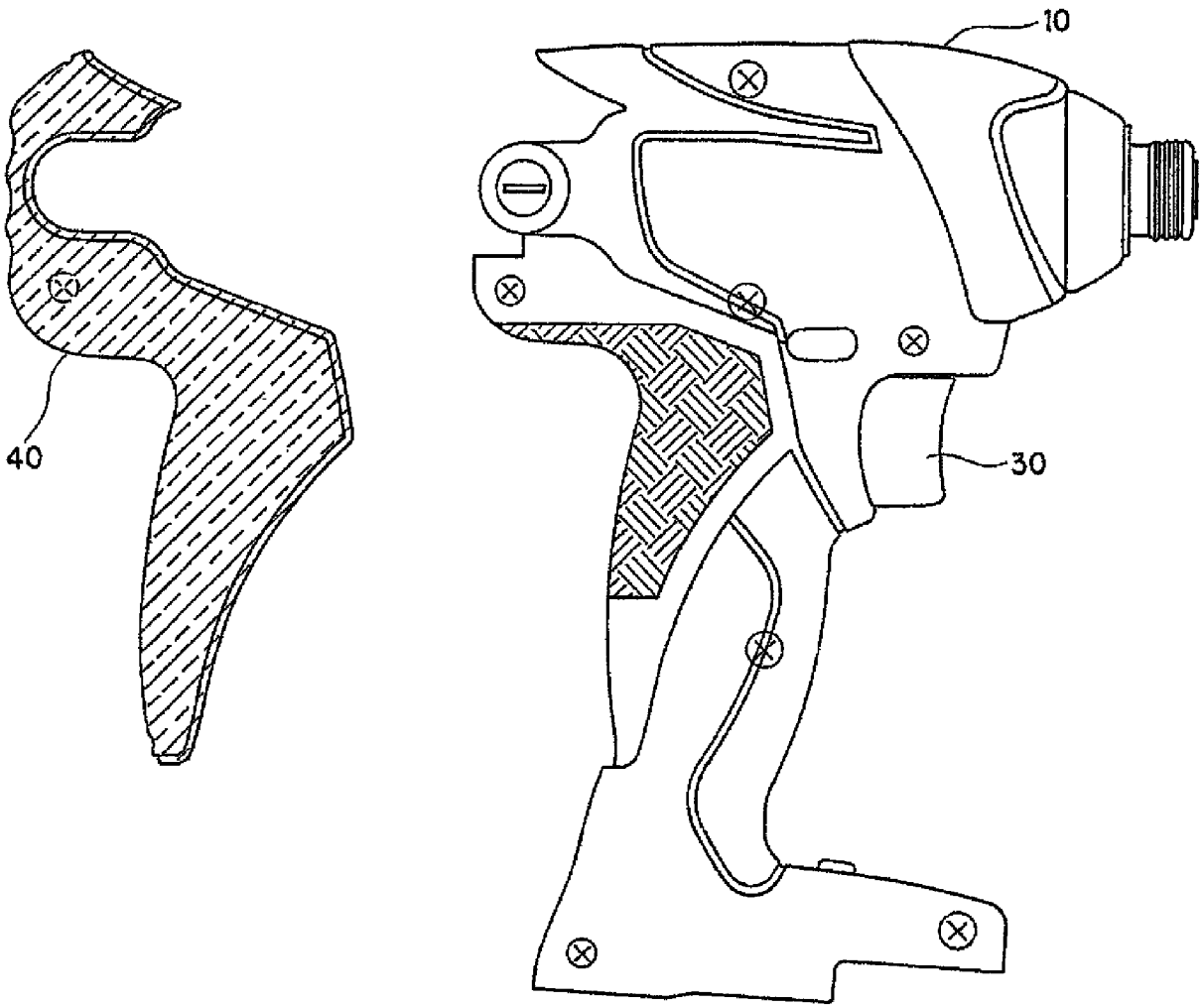
FIG. 4 is a view illustrating a structure of a housing of the power tool according to the embodiment of the present invention, in a state where a tail cover, which is normally secured to the housing, is removed.
Figure 4A:
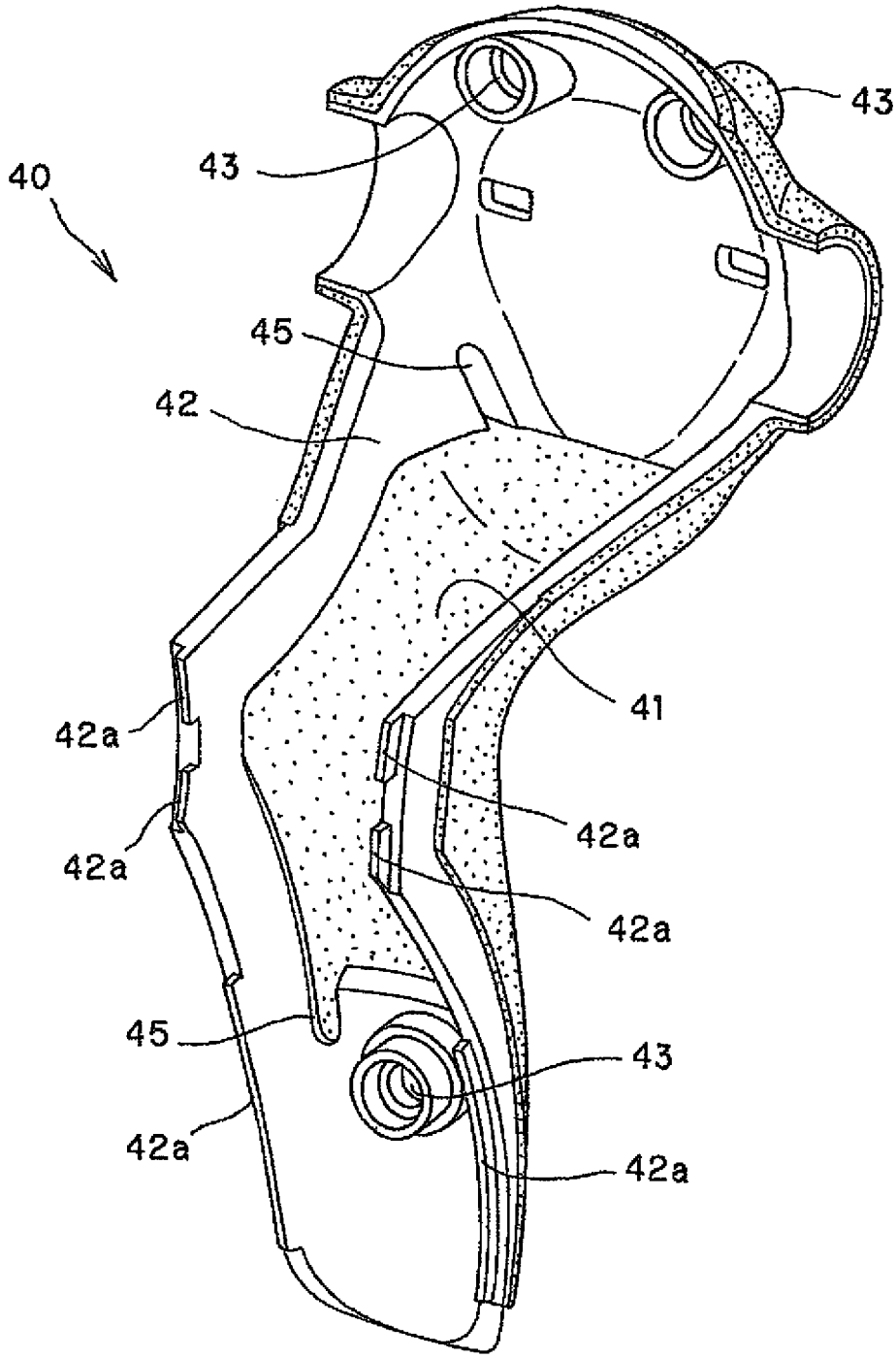
FIG. 4A is an external appearance perspective view showing a specific structure of the tale cover of the embodiment of the present invention.
Figure 4B:
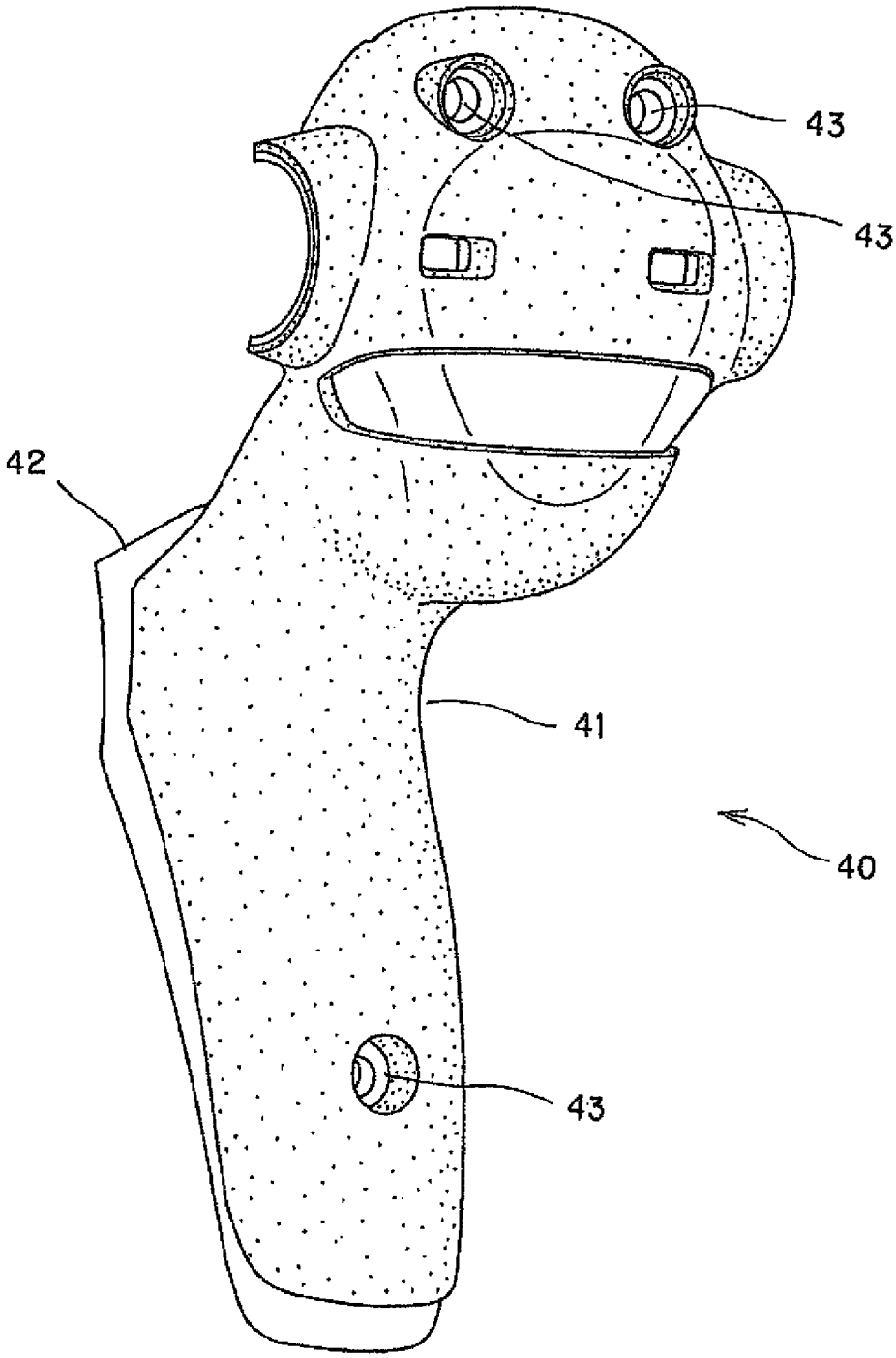
FIG. 4B is an external appearance perspective view showing a specific structure of the tale cover of the embodiment of the present invention.
Figure 4C:
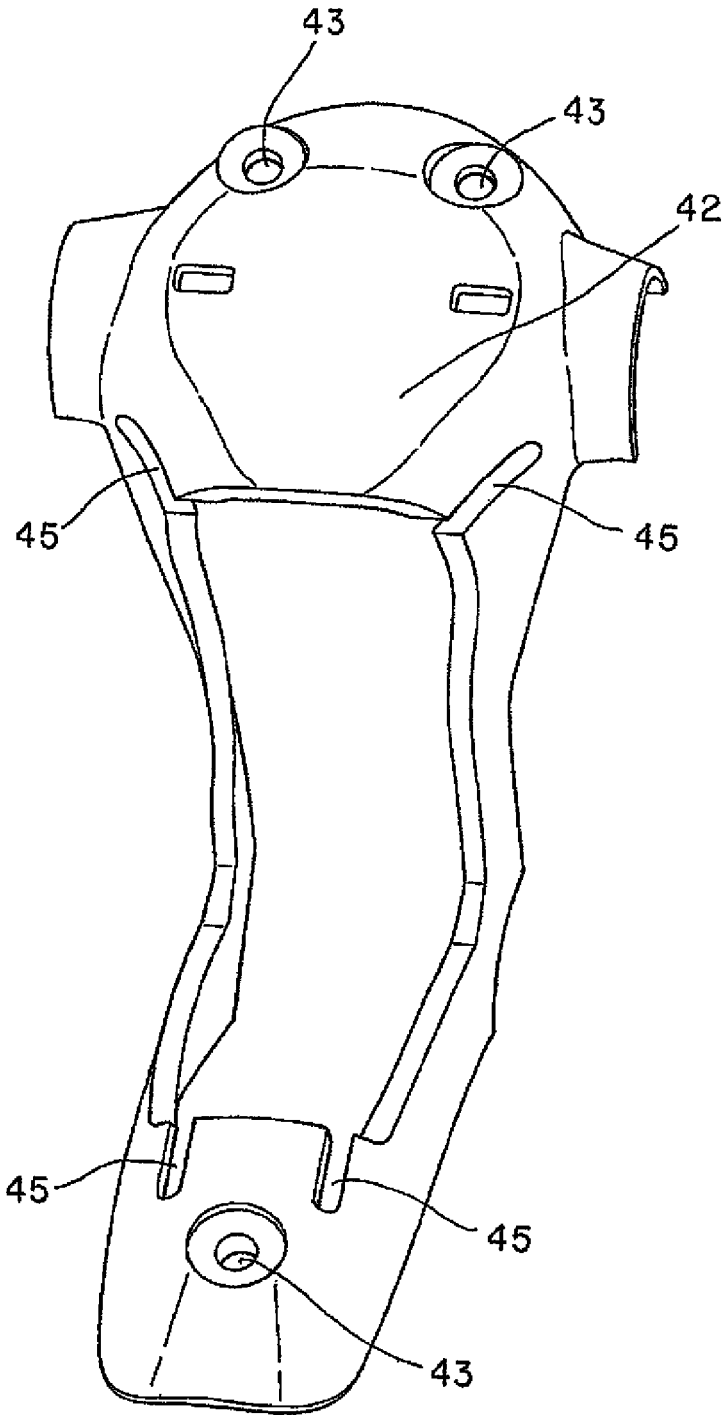
FIG. 4C is an external appearance perspective view showing a shape of a resin member forming the tale cover according to the embodiment of the present invention.
Figure 5:
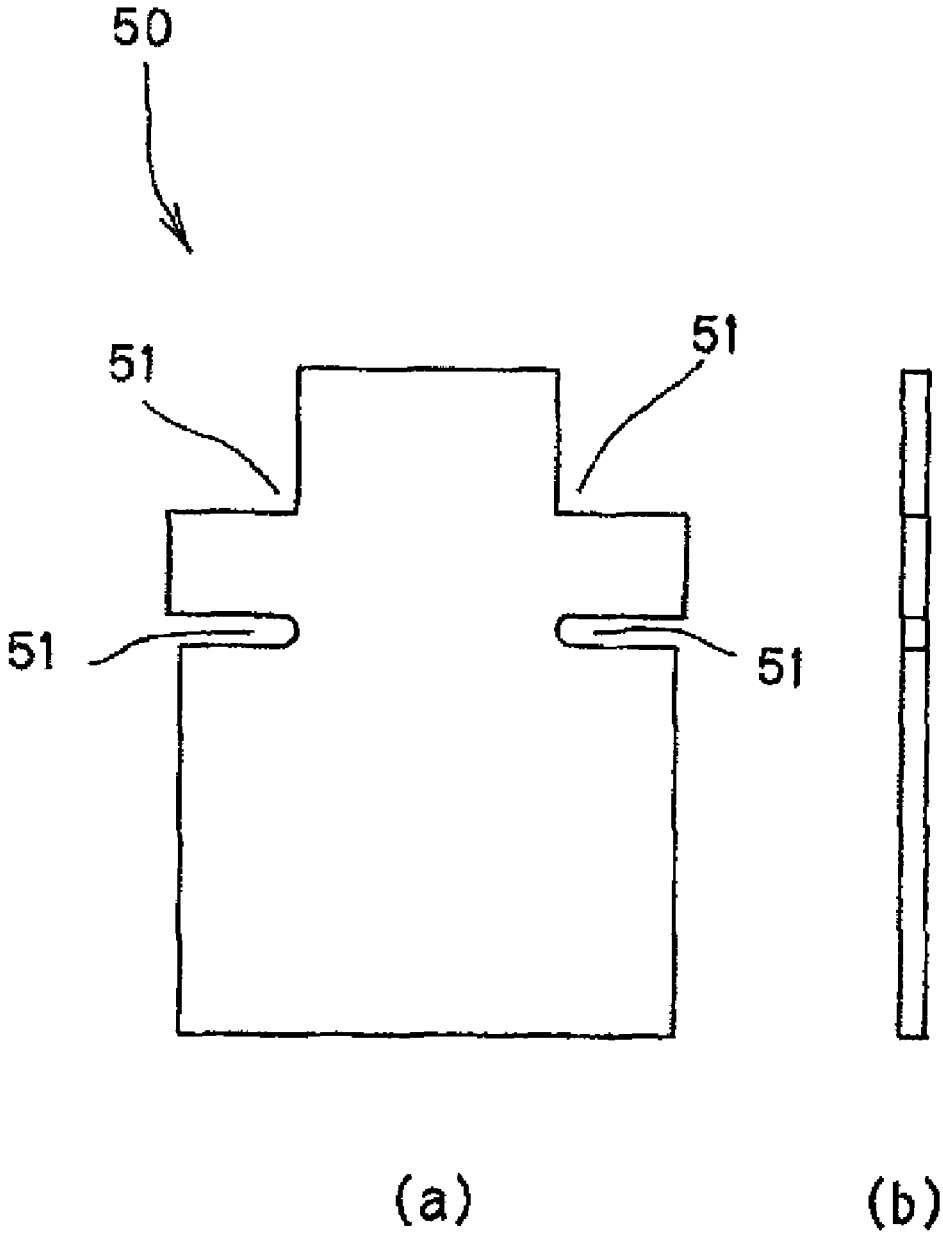
FIG. 5 is a view illustrating a gel-pack used in the power tool of the embodiment of the present invention, FIG. 5(*a*) is a front view of the gel-pack and FIG. 5(*b*) is a side view of the gel-pack.

The power tool according to the embodiment of the present invention has the above-described structure to permit to carry out a working operation relative to an external object, and has further significant features to attenuate impact to be applied to an operator. The significant features will be described below with reference to FIG. 4 to FIG. 5. FIG. 4 is a view illustrating the structure of the housing of the power tool according to the embodiment of the present invention, in a state where a tail cover, which is normally secured to the housing, is removed. FIGS. 4A and 4B are external appearance perspective views showing the specific structure of the tale cover of the embodiment of the present invention, and FIG. 4C is an external appearance perspective view showing a shape of a resin member forming the tale cover according to the embodiment of the present invention. FIG. 5 is a view illustrating a gel-pack used in the power tool of the embodiment of the present invention, FIG. 5(*a*) is a front view of the gel-pack and FIG. 5(*b*) is a side view of the gel-pack.

As shown in FIG. 4, the housing of the power tool according to the embodiment of the present invention has a structure in which the tale cover 40 is provided in the vicinity of at least a region of the housing 10, which is to be held by an operator. The tale cover 40 has a shape to provide a space between the housing 10 and the tale cover 40 fitted to the housing 10 so as to receive the gel pack 50 as shown in FIG. 5 in the above-mentioned space. The tale cover 40 having such a shape permits to function as an undercut portion, when conducting a bilayer formation, which will be described later with reference to FIG. 6, and as a gel pack-receiving portion 44 when the tale cover is fitted to the housing 10.

The specific structure of the tale cover 40 will be described below with reference to FIG. 4A and FIG. 4B. The tale cover 40 according to the embodiment of the present invention is composed of an elastomer member 41 and a resin member 42, which is integrally formed with the elastomer member 41 and has a higher hardness than the elastomer member, and has the specific features that the a portion of the tale cover, which receives the gel pack 50, is composed of the elastomer member 41 and a portion of the tale cover, which is connected to the housing 10, is composed of the resin member 42. More specifically, in the tale cover 40 according to the embodiment of the present invention, the resin member 42 having a higher hardness is used at a portion, which keeps the shape and serves as a framework for fitting to the housing, and the elastomer member 41 having a lower hardness is used at a portion, which is to be held by an operator, so that the gel-like material in the gel pack, which is received in the tale cover, can provide its stable functions.

The gel pack 50, which is received in the space between the housing 10 and the tale cover 40 (i.e., a gel pack-receiving portion 44) is a member in which the gel-like material is enclosed by a resin film, and has plurality of notches 51 as shown in FIG. 5. These notches 51 enable the gel pack 50 to deform into a complicated shape. Even when the gel pack 50 is placed in a space (i.e. the gel pack-receiving portion 44) having a complicated three-dimensional shape defined by the housing 10 and the tale cover 40 having the respective three-dimensional shapes with curved surfaces, the gel pack 50 may deform so as to fit into these three-dimensional shapes, thus fully exerting characteristic properties (resiliency, vibration insulation and impact absorption) of the gel pack 50.

The tale cover 40 according to the embodiment of the present invention is formed by a bilayer formation structure in which the elastomer member 41 is placed on the outer side of the resin member 42, and has a portion, which is composed only of the elastomer member 41 and is free of the resin member 42. The portion, which is free of the resin member 42, serves as a gel pack-receiving portion 44 (corresponding to an undercut portion described later with reference to FIG. 6), and the gel pack 50 is placed in the gel pack-receiving portion 44. More specifically, the gel pack 50 is supported at its periphery by the resin member 42 having the higher hardness and softly embraced by the elastomer member 41 having the lower hardness, thus permitting maintenance of a stable receiving condition.

The tale cover 40 according to the embodiment of the present invention is placed to cover at least regions of a rear side and both of opposite sides of the housing 10 in which the operation switch 30 is provided, and the tale cover has a shape to embrace most portion of the housing grip 10*b*, thus providing an effect of performing a stable mounting state to the housing.

Figure 6:
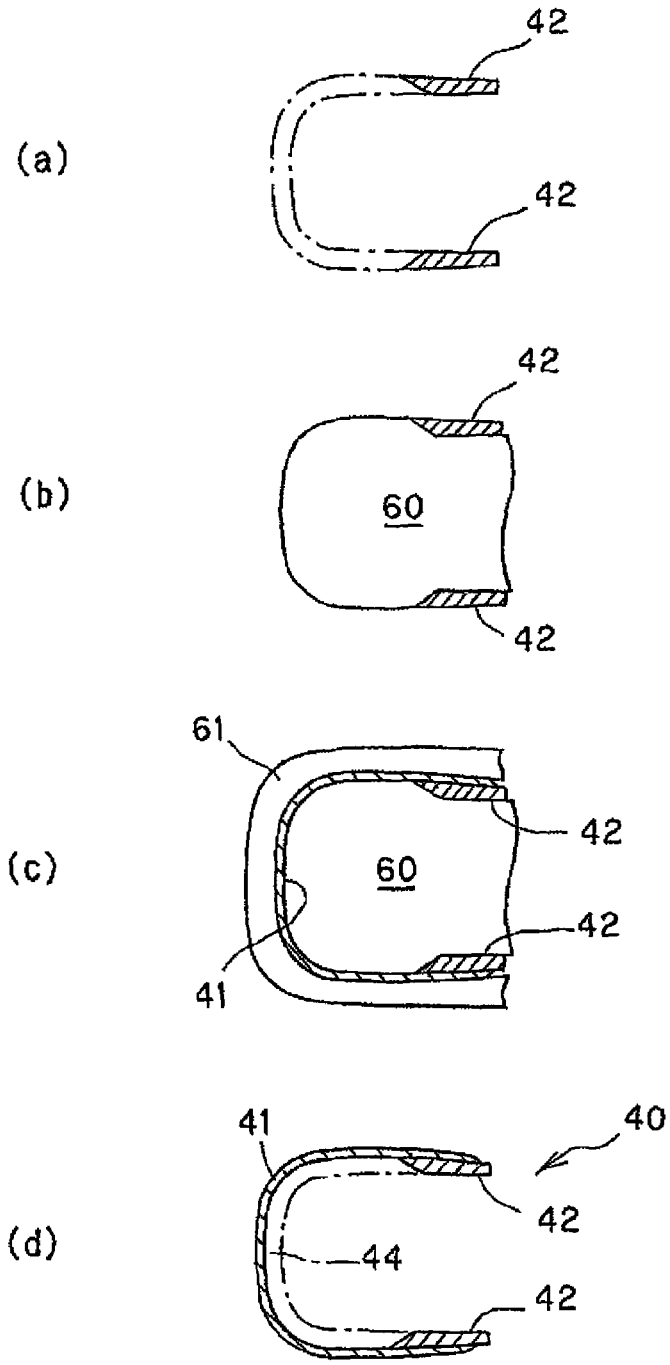
FIG. 6 is a view showing a method for manufacturing the tale cover according to the embodiment of the present invention, and FIGS. 6(*a*) to 6(*d*) illustrate respective formation of the tale cover cut along the line B-B as shown in FIG. 1.

Now, a method for manufacturing the tale cover as described above will be described with reference to FIG. 6. FIG. 6 is a view showing the method for manufacturing the tale cover according to the embodiment of the present invention, and FIGS. 6(*a*) to 6(*d*) illustrate respective formation of the tale cover cut along the line B-B as shown in FIG. 1

First, a primary formation step for the tale cover according to the embodiment of the present invention is carried out to form a part corresponding to the resin member 42 having a higher hardness to constitute a framework member of the tale cover 40 (see FIG. 4C and FIG. 6(*a*)).

Then, the resin member 42 is fitted into a secondary formation mold 60 (see FIG. 6(*b*)). The primarily formed part, i.e., the resin member 42 has flexibility to cause it to expand easily, and the resin member 42 according to the embodiment of the present invention is provided at four corner portions, which are to be placed closely to the gel pack-receiving portion 44, with slits 45. Forming the slits 45 at the four corner portions of the resin member 42, which are to be placed closely to the gel pack-receiving portion 44, makes it possible to fit easily the resin portion 42 into the secondary formation mold 60. In the secondary formation mold 60 into which the resin member 42 is placed, the adjacent portion of the resin member 42 to the gel pack-receiving portion 44 has a shape to provide an undercut portion, when conducting a bilayer formation with the elastomer member 41. It is therefore possible to prevent the resin member 42 from deviating from a proper position in the secondary formation mold, thus ensuring a properly fitting state of the resin member 42 into the mold, with no need to provide specific ribs or the like to support the resin member 42 on the secondary formation mold 60.

Then, another mold 61 is placed around the secondary formation mold 60 into which the resin member 42 has been fitted, and the elastomer member 41 is formed (see FIG. 6(*c*))).

Then, the secondary formation mold 60 and the other mold are removed and the tale cover 40 is manufactured.

The thus manufactured tale cover 40, in which the elastomer member 41 is integrally formed with the outer side of the resin member 42 by carrying out a bilayer formation process, has a portion, which is composed only of the elastomer member 41 and is free of the resin member 42. This portion being free of the resin portion 42 forms the gel pack-receiving portion 44. The gel pack-receiving portion 44 provides a function of maintaining a stable receiving condition of the gel pack 50.

Figure 7:
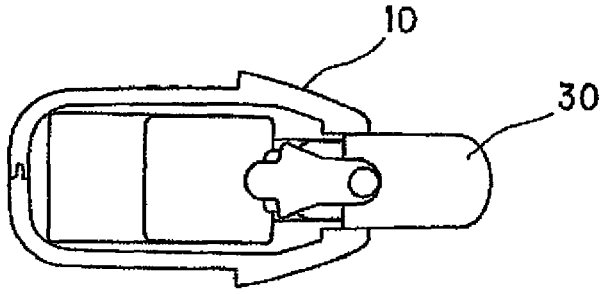
FIG. 7 is a view showing a way to fit the tale cover to the housing in the power tool according to the embodiment of the present invention and a fitting state thereof, and FIGS. 7(*a*) to 7(*c*) illustrate respective formation of the tale cover cut along the line B-B as shown in FIG. 1.
Figure 7:
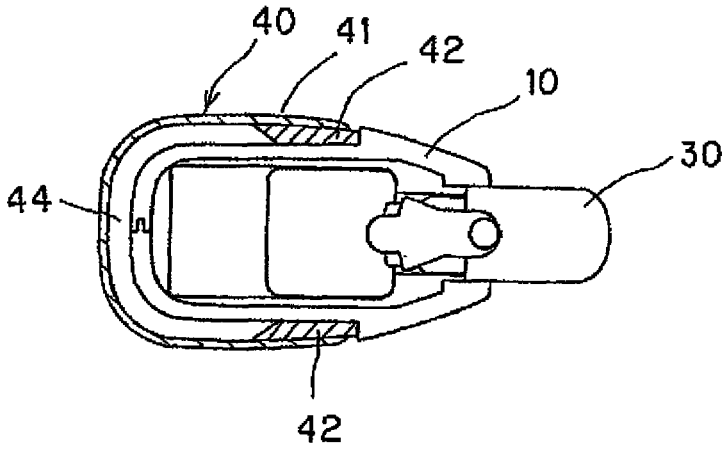
Figure 7:
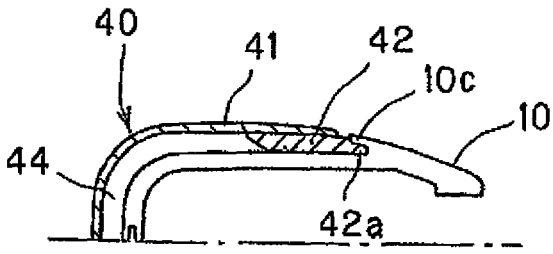

Now, description will be given below of a way to fit the tale cover 40 to the housing 20 and a fitting state thereof with reference to FIG. 7. FIG. 7 is a view showing the way to fit the tale cover to the housing in the power tool according to the embodiment of the present invention and a fitting state thereof, and FIGS. 7(*a*) to 7(*c*) illustrate respective formation of the tale cover cut along the line B-B as shown in FIG. 1.

FIG. 7(*a*) shows the power tool before the tale cover 40 is fitted to the housing 10. The tale cover 40 is fitted to the housing so that the portions of the resin member 42, which has a higher hardness and has the function as the framework of the tale cover 40, are connected to the housing 10, as shown in FIG. 7(*b*). The connection of the tale cover 40 to the housing is made by fitting projections 42*a*, which are formed at the portions of the resin member 42 of the tale cover 40, into recesses 10 formed in the housing 10. Bolt-holes 43 as shown in FIG. 4A and FIG. 4B may be utilized to achieve a stable connection of the tale cover 40 to the housing 10.

Figure 8:
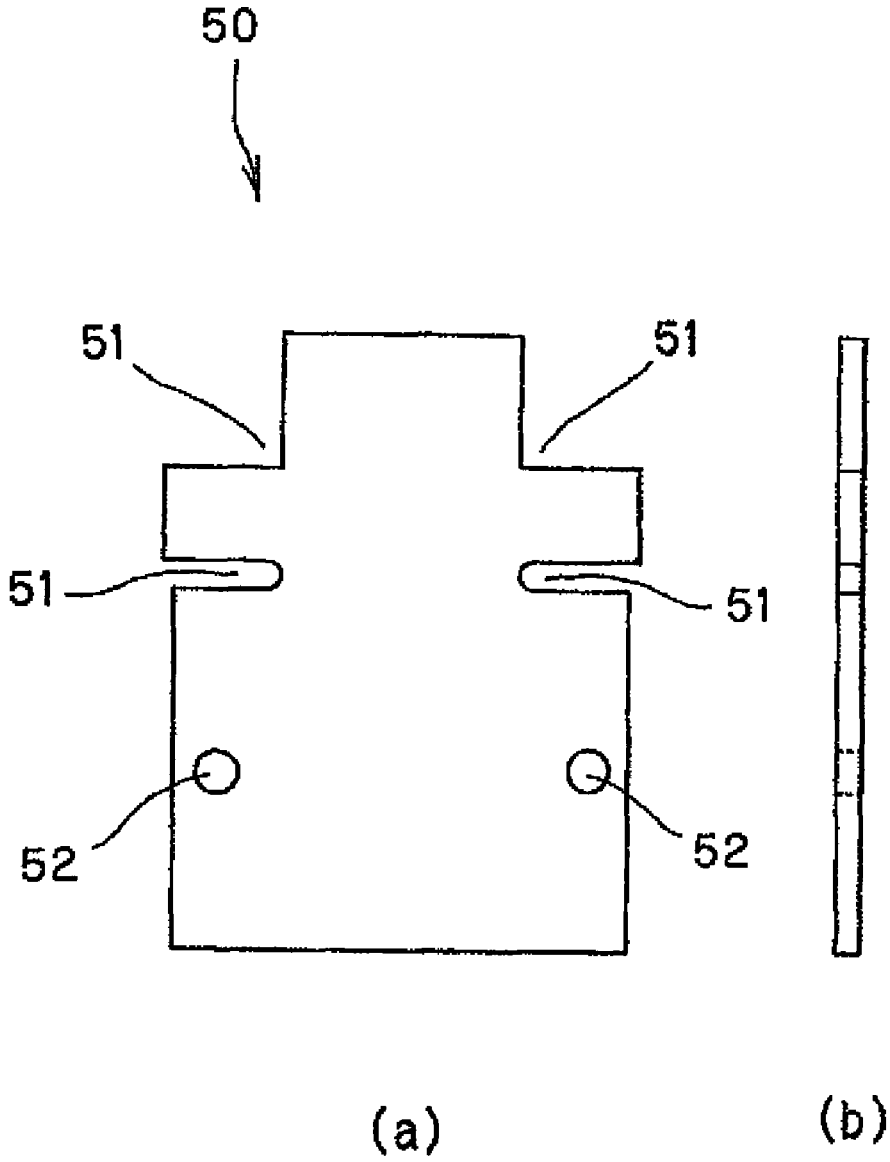
FIG. 8 is a view illustrating the different type of gel-pack used in the power tool of the present invention.

Owing to the specific structures as described above of the housing 10 and the tale cover 40, and the function of the plurality of notches formed in the gel pack 50, the stable receiving condition of the gel pack 50 can be maintained. It is preferable to form through-holes 52 in the gel pack 50 in order to prevent more effectively deviation of the gel pack between the tale cover 40 and the housing 10. When the plurality of through-holes 52 are formed in the gel pack 50 as shown in FIG. 8 and securing projections, which extend from the housing 10 or the tale cover 40, are inserted into the above-mentioned through-holes 52 to ensure a firmer connection of the gel pack to the housing 10, even application of any external force does not cause a positional deviation of the gel pack 50. Therefore, use of the type of gel pack 50 as shown in FIG. 8 makes it possible to provide the power tool in which the gel-like material can fully exert its characteristic properties (resiliency, vibration insulation and impact absorption).

The preferred embodiment of the present invention has been described above. However, the scope of the present invention should not be considered to be restrictive on the basis of the description of the embodiment. The embodiment as described above may be subject to various modifications or improvements.

For example, silicone gel, acryl gel, urethane gel or the like may be used as the gel-like material used in the gel pack 50, and a polyurethane resin film, a silicone resin film, a fluororesin film or the like, which has an excellent durability and an excellent resistance to chemicals, may be used as the resin film by which the gel-like material is enclosed. The resin film may be used in the form of a single sheet or a laminated sheet. An applicable thickness of the resin film may be within the range of from 50 μm to 500 μm, and it is preferable to use the resin film having a thickness of about 300 μm for example in the power tool according to the embodiment of the present invention.

Concerning hardness of the structural components of the power tool according to the embodiment of the present invention, the resin member 42, the elastomer member 41 and the gel-like material (gel pack 50) have different standards in hardness, and the hardness of them has to be indicated based on relative comparison. On the assumption that, for example, the housing 10 has a hardness of "10", there may be used the following structural components having the respective hardness:

| | |
|---|---|
| housing 10: | "10" |
| elastomer member 41: | "2" |
| resin member 42: | "9" |
| gel pack 50: | "0.1" |

Incidentally, the hardness of the gel pack 50 used in the embodiment of the present invention corresponds to a value of 100±50 of a penetrometer (JIS K-2207). A preferably applicable range in the present invention is between 50 to 200.

In the power tool according to the present invention, the gel pack 50 may be substituted with material, which has the similar function to the gel pack 50 according to the embodiment of the present invention. For example, viscoelastic polymer, which has a very high impact absorption property and a remarkable pressure dispersion function, may provide the similar functions to the gel pack 50 having functions of impact energy absorption and vibration insulation. "SORBO™" sold by Sanshin Enterprise Co. Ltd. (Sorbo Japan) may be mentioned as a specific example of viscoelastic polymer. "SORBO™", which may retain its shape with no need to provide a member corresponding to the resin film to enclose the gel-like material as in the gel pack 50, is more preferable. Concerning the specific shape of "SORBO™", the shapes as shown in FIG. 5 and FIG. 8 may be preferably applied. In case where the above-mentioned viscoelastic polymer is applied as the gel pack 50 in the present invention, the gel pack-receiving portion 44 described in the embodiment of the present invention serves as the viscoelastic polymer-receiving portion.

It is clearly understood from the appended claims that any modified or improved embodiments are considered as being within the scope of the present invention.

What is claimed is:

1. A power tool, comprising:

a driving force transmission mechanism that transmits a rotary driving force from a rotary drive source to operate the power tool;

a housing that receives said driving force transmission mechanism therein and provides an outer shell for the power tool;

a tail cover provided at at least a region of said housing, which region is to be held by an operator, said tail cover comprising an elastomer member integrally formed with a resin member, said resin member having a higher hardness than said elastomer member, said tail cover having a bilayer formation structure with said elastomer member placed on an outer side of said resin member, said resin member defining a portion connected to said housing, said elastomer member defining a receiving portion, said receiving portion being one of i) a gel pack-receiving portion and ii) a viscoelastic polymer-receiving portion, said receiving portion being composed only of said elastomer member and being free of said resin member; and one of i) a gel pack containing a gel-like material enclosed by a resin film, and ii) a viscoelastic polymer placed between said tale cover and said housing in said receiving portion formed by said elastomer member.

2. The power tool as claimed in claim 1, wherein:

an adjacent portion of said resin member to said gel pack-receiving portion or said viscoelastic polymer-receiving portion has a shape to provide an undercut portion, when conducting a bilayer formation with said elastomer member; and said resin member has a shape to be fitted into a mold, when forming said resin member and said elastomer member integrally with each other to form said tale cover.

3. The power tool as claimed in claim 1, wherein:

said resin member is provided at an adjacent portion thereof to said gel pack-receiving portion or said viscoelastic polymer-receiving portion with a slit.

4. The power tool as claimed in claim 3, wherein:

each of said housing and said tale cover has a three-dimensional shape having a plurality of curved surfaces; and said gel pack or said viscoelastic polymer, which is placed in a space defined by said three-dimensional shape, has notches fitting into said three-dimensional shape.

5. The power tool as claimed in claim 3, further comprising:

an operation switch provided on a front side of the power tool to control operation thereof; and wherein: said gel pack or said viscoelastic polymer is placed to cover at least regions of a rear side and both of opposite sides of said housing in which said operation switch is provided.

6. The power tool as claimed in claim 3, wherein:

said gel pack or said viscoelastic polymer has through-holes to prevent movement thereof between said tale cover and said housing to secure said gel pack or said viscoelastic polymer to said housing.

7. The power tool as claimed in claim 1, wherein:

each of said housing and said tale cover has a three-dimensional shape having a plurality of curved surfaces; and said gel pack or said viscoelastic polymer, which is placed in a space defined by said three-dimensional shape, has notches fitting into said three-dimensional shape.

8. The power tool as claimed in claim 7, further comprising:

an operation switch provided on a front side of the power tool to control operation thereof; and wherein:

said gel pack or said viscoelastic polymer is placed to cover at least regions of a rear side and both of opposite sides of said housing in which said operation switch is provided.

9. The power tool as claimed in claim 1, further comprising:

an operation switch provided on a front side of the power tool to control operation thereof; and wherein:

said gel pack or said viscoelastic polymer is placed to cover at least regions of a rear side and both of opposite sides of said housing in which said operation switch is provided.

10. The power tool as claimed in claim 1, wherein: further comprising:

projections in one of the housing and tale cover, through-holes in the one of said gel pack or said viscoelastic polymer, the projections inserted into the through-holes to prevent movement thereof between said tale cover and said housing to secure said gel pack or said viscoelastic polymer to said housing.

11. The power tool as claimed in claim 2, wherein:

said resin member is provided at an adjacent portion thereof to said gel pack-receiving portion or said viscoelastic polymer-receiving portion with a slit.

12. The power tool as claimed in claim 2, wherein:

each of said housing and said tale cover has a three-dimensional shape having a plurality of curved surfaces; and said gel pack or said viscoelastic polymer, which is placed in a space defined by said three-dimensional shape, has notches fitting into said three-dimensional shape.

13. The power tool as claimed in claim 2, further comprising:

an operation switch provided on a front side of the power tool to control operation thereof; and wherein:

said gel pack or said viscoelastic polymer is placed to cover at least regions of a rear side and both of opposite sides of said housing in which said operation switch is provided.

14. The power tool as claimed in claim 1, further comprising:

projections in one of the housing and tale cover, through-holes in the one of said gel pack or said viscoelastic polymer, the projections inserted into the through-holes to prevent movement thereof between said tale cover and said housing to secure said gel pack or said viscoelastic polymer to said housing.

* * * * *